US005356186A

United States Patent [19]

Favaro

[11] Patent Number: 5,356,186

[45] Date of Patent: Oct. 18, 1994

[54] LATCH MECHANISM FOR A HOME APPLIANCE

[75] Inventor: Daniele Favaro, Pramaggiore, Italy

[73] Assignee: Zanussi Elettrodomestici S.P.A., Italy

[21] Appl. No.: 94,558

[22] Filed: Jul. 20, 1993

[30] Foreign Application Priority Data

Jul. 23, 1992 [IT] Italy ..... PN92U000028

[51] Int. Cl.[5] ..... E05C 3/06

[52] U.S. Cl. ..... 292/216; 292/221; 292/170; 292/DIG. 37

[58] Field of Search ..... 292/216, 221, 229, DIG. 37, 292/DIG. 57, DIG. 63, 124, 126, 129, 170

[56] References Cited

U.S. PATENT DOCUMENTS

| | | | |
|---|---|---|---|
| 2,937,045 | 5/1960 | Leslie et al. | 292/DIG. 37 X |
| 3,127,206 | 3/1964 | Jakeway | 292/DIG. 37 X |
| 3,677,591 | 7/1972 | Waldo | 292/221 |
| 3,696,648 | 10/1972 | Horgan, Jr. | 292/DIG. 57 X |
| 3,999,792 | 12/1976 | Smith | 292/DIG. 63 X |
| 4,073,170 | 2/1978 | Miyobayaski et al. | 292/DIG. 37 X |
| 4,083,589 | 4/1978 | Palmerino | 292/DIG. 37 X |
| 4,372,591 | 2/1983 | Cook et al. | 292/221 |

FOREIGN PATENT DOCUMENTS 2238576 11/1990 United Kingdom .

*Primary Examiner*—Rodney M. Lindsey

*Attorney, Agent, or Firm*—Pearne, Gordon, McCoy & Granger

[57] ABSTRACT

An apparatus for a home appliance with a closing door (1) housing a hook (6) which holds a pin (7) which is affixed to a frame in order to lock the door in a closed position. The door opens to the front (9) and is normally closed by a small shutter (10) which is on a slider (11) which slides towards the inside of the door (1) along runner guides (12, 13) to unlatch the hook (6) from the pin (7) by an activating lever (15). The latter's fulcrum is at a point adjacent to the front surface of the door and extends inside the port itself with a free end (19) which works with an inclined plane (17) of the slider (11).

3 Claims, 3 Drawing Sheets

LATCH MECHANISM FOR A HOME APPLIANCE

BACKGROUND OF THE INVENTION

The present invention refers to an apparatus, specifically, a home appliance, with an access door which can be closed by means of a locking mechanism that can be activated through a front opening of the door to unhook the door itself.

Home appliances, especially dishwashers, are known, in which a front door is normally closed by a shutter-like door. The door is hinged in such a way as to be able to rotate when a hand is inserted to access the locking mechanism. Such a solution is advantageous from the hygienic and aesthetic point of view but presents the problem that one's fingers can easily get stuck between the shutter and the locking mechanism. In any case, the locking mechanism is unwieldy.

The aim of the present invention is to supply an apparatus, specifically for home appliances, with a door having a closing mechanism which can be activated in a particularly easy and exact way by means of an opening in the door which is normally closed.

According to the invention, such an objective is obtained in an apparatus, specifically for a home appliance, with a door which incorporates the characteristics described in the attached claims.

BRIEF DESCRIPTION OF THE DRAWINGS

The characteristics and the advantages of the invention will be shown by the following description, which is given as a non-limiting example, and which refers to the drawings in which.

DETAILED DESCRIPTION OF THE PREFERRED EMBODIMENT

Figure 1:
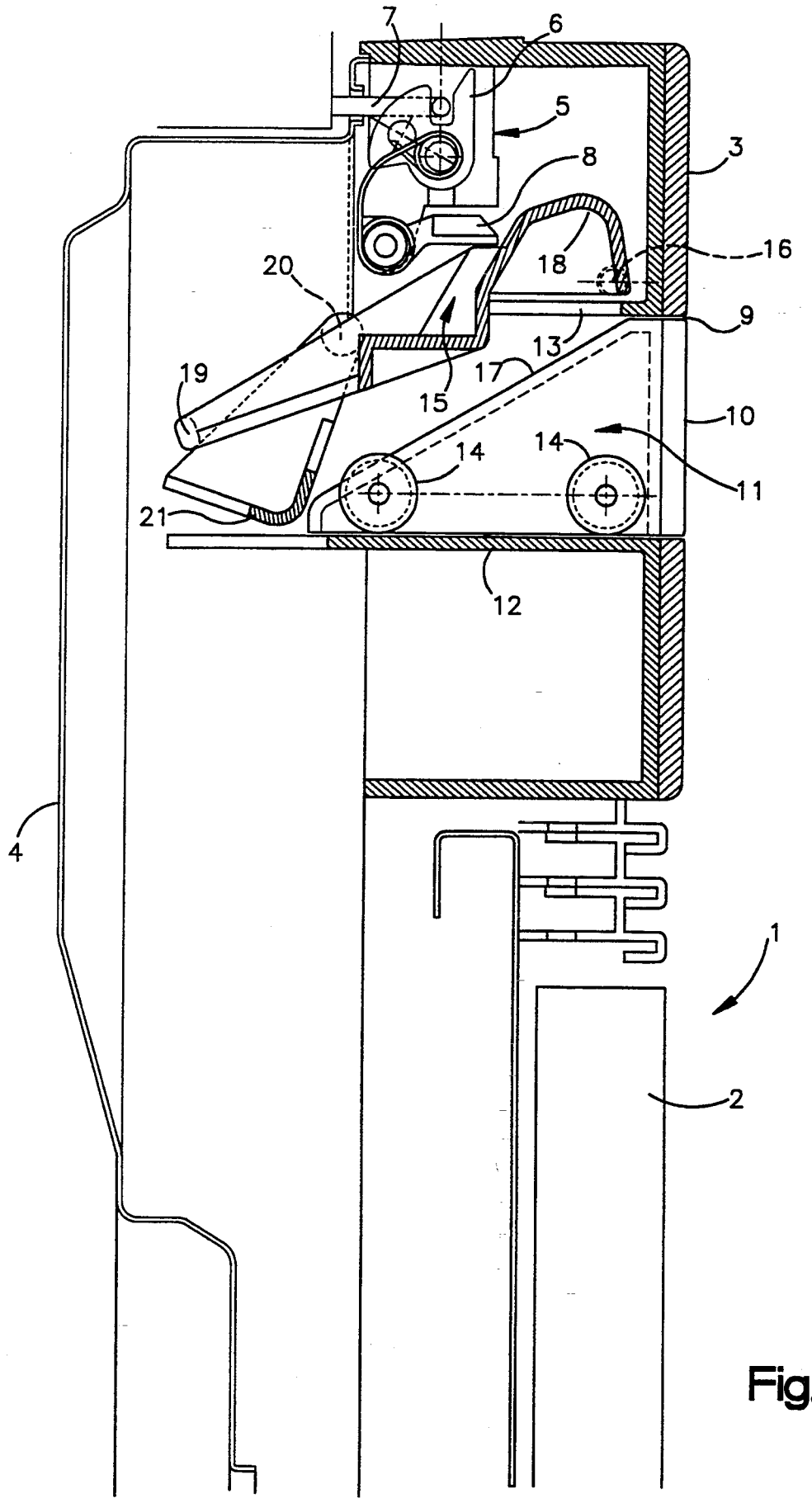
FIGS. 1, 2 and 3 schematically show a section view of a preferred manner of construction for the frame, according to the invention, in its respective operational positions.

With reference to the figures, the frame is part of an example of a substantially traditional dishwasher with a front door (1) hinged at the bottom of the machine. In particular, the door (1) includes an external portion formed by a panel (2) which extends to a dashboard (3), or something similar, at the top of the door, for the machine controls. In addition, the door (1) includes an internal counter-door (4) coupled to an external portion of the door in order to define an internal cavity. The internal cavity houses a well-known type of locking mechanism (5) which, for example, includes a hinged pin (7) into which a pin (7) fits. This hook (6) is attached to the machine's frame in order to lock the door (1) in its closed position. The hook (6) can be unhooked by using a lever (8). A locking mechanism of this type is well-known, for example, from GB-A-2 238 576.

Corresponding to the dashboard (3), the door (1) has a front opening (9) which is normally closed by a shutter (10) (FIG. 1). The shutter (10) should preferably be formed by the front surface of a slide (11) which, in itself, has an inclined plane (17), or something similar, and slides, on hinges or springs, towards the inside of the door (1) along runner guides which are substantially straight and horizontal (12, 13). Preferably, the slide (11) would work in conjunction with at least one of the runner guides (12, 13) by means of wheels (14), or something similar, allowing it to shift somewhat smoothly.

As will be demonstrated in the following, the slide (11) will activate the locking mechanism (5) in order to unlatch the hook (6) and allow the opening of the door (1) by means of a lever (15). Such a lever (15) is balanced at a fulcrum (16) at a position adjacent to the front surface of the door (1) and extends obliquely towards the counter-door (4) to a free end (19) which is relatively far from the fulcrum (16). The lever (15) includes a concave portion (18) adjacent to the fulcrum (16) into which one can fit one's fingers through the front opening (9) in order to open the door (1).

Preferably, another lever (21), squared-off, would be freely balanced at a fulcrum (20) in a position between the fulcrum (16) and the free end (19) on the lever (15).

When the door (1) of the frame is closed, the components described above are in the "resting" position shown in FIG. 1 with the pin (7) latched into the hook (6) and the shutter door (10) lined up with the external edge of the control panel (3).

Figure 2:
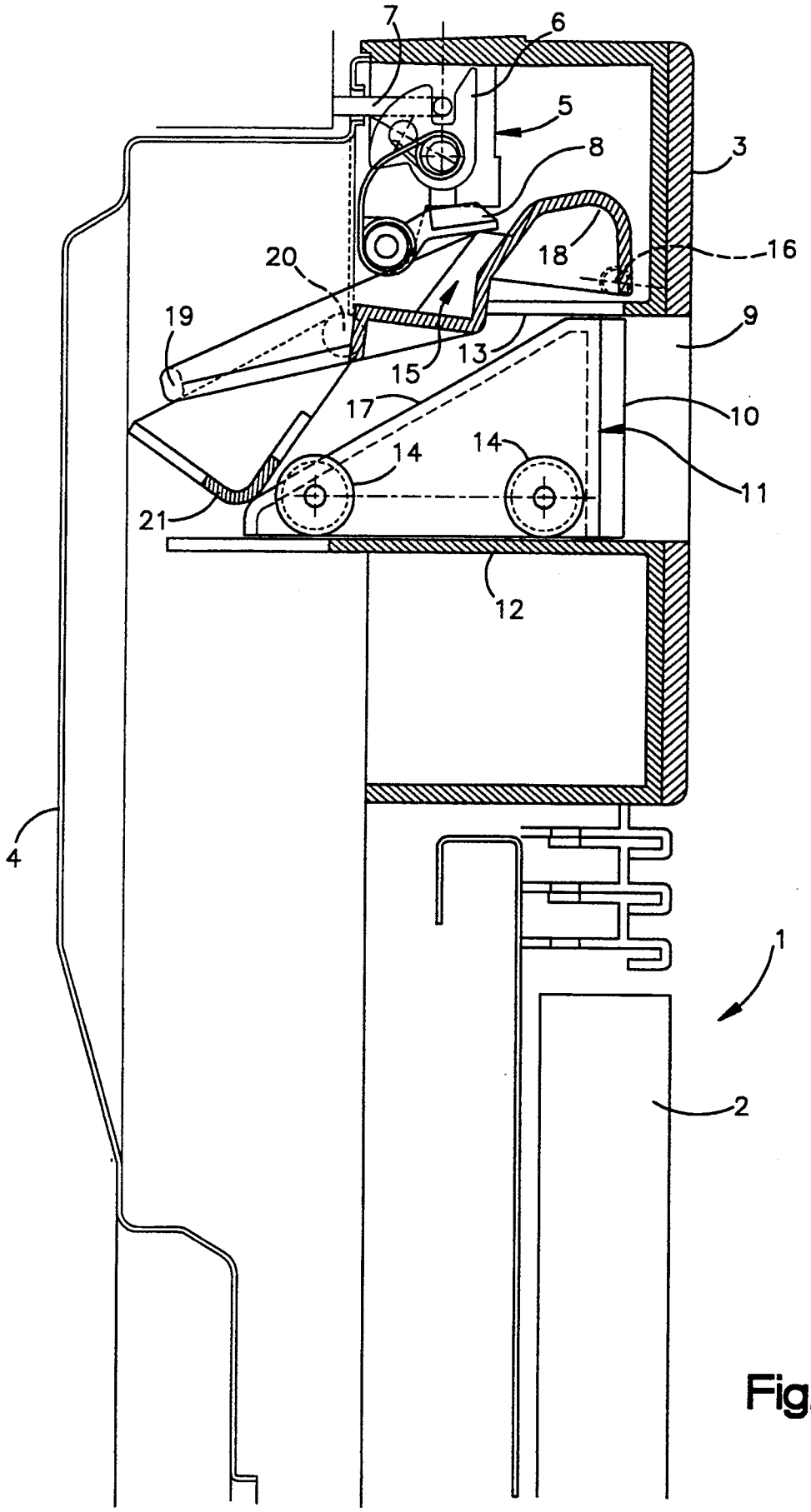

When the door (1) has to be opened, it is enough to shift the slide (11) towards the counter-door (4) (FIG. 2), for example, by pressing the shutter door (10) with a finger. Along its horizontal path, the slide (11) comes into contact with the lever (21), making it rotate clockwise to contact the free end (19) of the lever (15).

Figure 3:
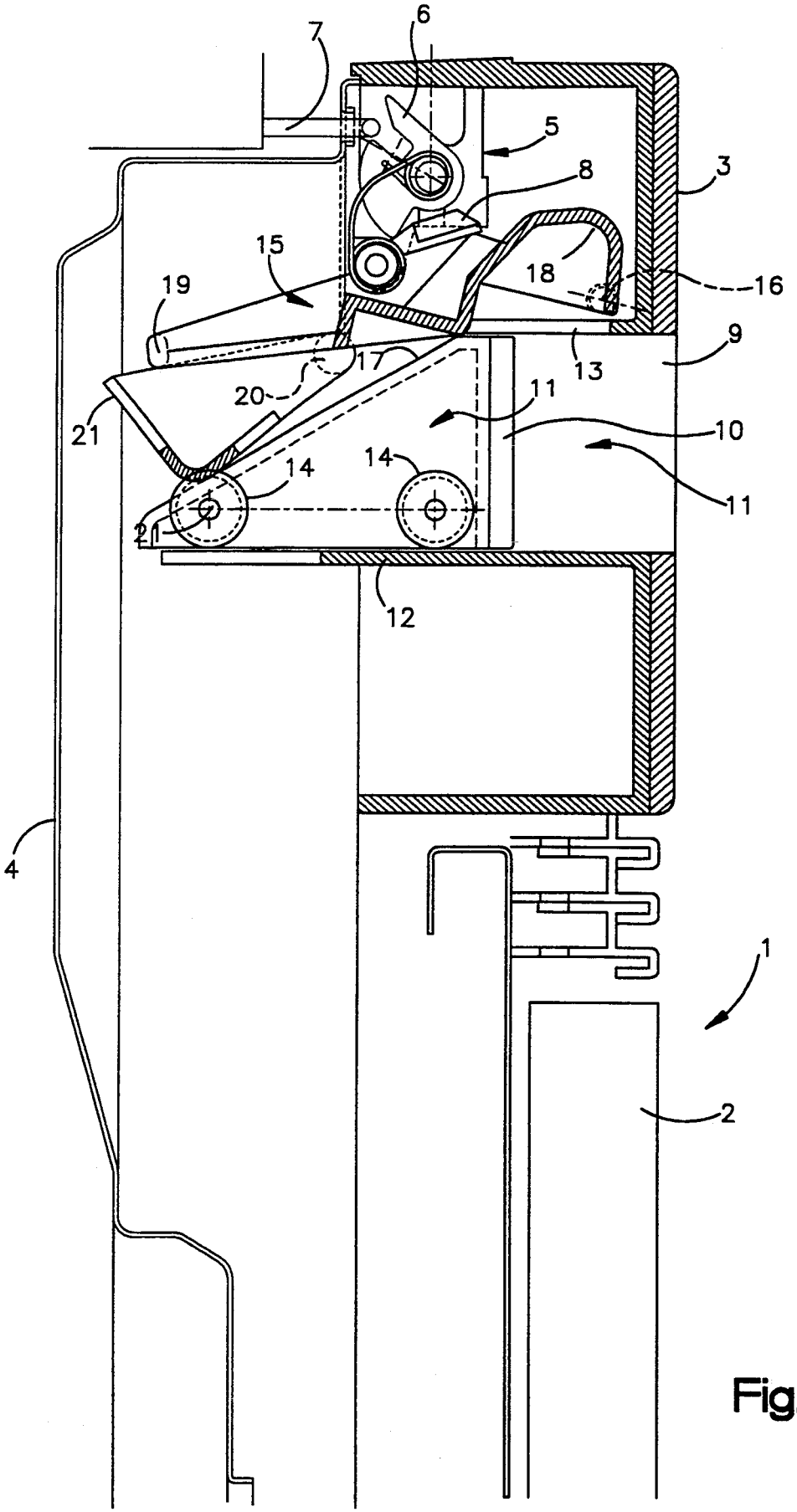

When the slide (11) continues along its path (FIG. 3), the lever (21) cooperates in sliding with the inclined plane (17) to raise the end (19) of the lever (15) which then rotates clockwise to make the lever (8) rotate in the opposite direction of the locking mechanism (5). Please note that interposing the lever (21) between the slide (11) and the lever (15) substantially avoids any blockage of the various mechanical parts that work in conjunction with each other while the length of the lever (15) substantially reduces the force which needs to be applied by the user to the lever (11).

In a manner which is in and of itself well-known, the rotation of the lever (8) at a certain point unhooks the pin (7) from the hook (6), disengaging the door (1) from the machine's frame. Under this condition, the slide (11) has penetrated the opening (9) sufficiently as to allow the concave portion (18) of the lever (15) to be hooked with one's finger and to pull the door (1) easily towards its open position.

By what has been described, it should be apparent from the simplicity and functionality of the construction, according to the invention, that the door can be opened in a manner that is particularly easy and gentle, by the simple pressure of one finger.

Obviously, the apparatus described is only an example and can undergo numerous modifications, as long as these are within the characteristics described in the attached claims. For example, the door (1) could be hinged around a horizontal or vertical axis and, as has already been stated, can be applied to any other structure for home appliances.

Although the preferred embodiments of this invention have been shown and described, it should be understood that various modifications and rearrangements of the parts may be resorted to without departing from the scope of the invention as disclosed and claimed herein.

What is claimed is:

1. An apparatus with a closing door which houses a locking mechanism, including a sprung hook which holds a pin affixed to a frame in order to lock the door in a closed position and a lever for unhooking the sprung hook; a front opening of the door normally closed by a small shutter (10) on a slider (11) having an incline (17) and which runs along runner guides (12, 13) towards the inside of the door (1); and an activating lever (15) balanced at a fulcrum (16) adjacent to a front surface of the door and extending to the inside of the door, and having a free end (19) operated by the incline (17) of the slider (11) so as to activate the locking mechanism (5) by tripping the lever (8) so as to unlatch the hook (6) from the pin (7).

2. An apparatus according to claim 1, characterized by the fact that said incline (17) of the slider (11) works in conjunction with the free end (19) of the activating lever (15) through the use of a start-up lever (21) on which the activating lever (15) rests said start-up lever having a fulcrum (20) disposed between the fulcrum (16) of the activating lever and the free end (19).

3. An apparatus according to claim 1, characterized by the fact that the slider (11) runs along the runner guides (12, 13) by means of wheels (14).

* * * * *